United States Patent [19]

Rieger et al.

[11] Patent Number: 4,932,235

[45] Date of Patent: Jun. 12, 1990

[54] ARRANGEMENT FOR THE COUPLING AND UNCOUPLING OF GRIPPER RAIL PARTS

[75] Inventors: Walter Rieger, Göppingen; Karl Thudium, Wäschenbeuren, both of Fed. Rep. of Germany

[73] Assignee: L. Schuler GmbH, Goppingen, Fed. Rep. of Germany

[21] Appl. No.: 373,442

[22] Filed: Jun. 30, 1989

[30] Foreign Application Priority Data

Jul. 2, 1988 [DE] Fed. Rep. of Germany ..... 3822473

[51] Int. Cl.[5] ..... B21J 13/08

[52] U.S. Cl. ..... 72/405; 198/621

[58] Field of Search ..... 72/405, 422; 198/621, 198/774; 414/750, 751

[56] References Cited

U.S. PATENT DOCUMENTS

| | | | |
|---|---|---|---|
| 3,875,808 | 4/1975 | Okamoto et al. | 74/29 |
| 4,557,133 | 12/1985 | Mikusch et al. | 72/405 |
| 4,753,102 | 6/1988 | Braun et al. | 72/405 |
| 4,823,587 | 4/1989 | Wolfgang et al. | 72/405 |

FOREIGN PATENT DOCUMENTS

| | | | |
|---|---|---|---|
| 8202432 | 3/1983 | Fed. Rep. of Germany . | |
| 3150508 | 11/1983 | Fed. Rep. of Germany . | |
| 3437241 | 4/1986 | Fed. Rep. of Germany | 72/405 |
| 3636010 | 4/1988 | Fed. Rep. of Germany . | |
| 2166988 | 5/1986 | United Kingdom | 72/405 |

*Primary Examiner*—Daniel C. Crane

*Attorney, Agent, or Firm*—Barnes & Thornburg

[57] ABSTRACT

To facilitate a mounting of end areas of gripper rails having exchangeable parts, in a transfer press during a set up change, elements for coupling and uncoupling the exchangeable gripper rail parts are integrated into a constructional unit. This constructional unit includes separatable housing components in which an adjusting device is arranged in one of the housing components which has a slidable clamp bolt. The clamp bolt can be clamped behind a clamping surface in the other housing component. Guided along with the clamp bolt are centering bolts for aligning of the gripper rail parts with respect to one another and a guide bolt for the moving of a carriage located outside the constructional unit.

14 Claims, 2 Drawing Sheets

ARRANGEMENT FOR THE COUPLING AND UNCOUPLING OF GRIPPER RAIL PARTS

BACKGROUND AND SUMMARY OF THE INVENTION

The present invention generally relates to an arrangement for connecting individual components of a gripper rail system, and more particularly to an arrangement for significantly simplying the construction of end areas of individual components of the gripper rail system to be connected.

The gripper rails of a transfer press typically include a plurality of gripper rail parts which are connected to one another. The gripper rail parts located in the area of the press frame remain in the press. The gripper rail parts which carry the gripping devices, however, are changed when the transfer press is set up for working another workpiece.

For transfer of the workpieces to the working stages during press operation, the gripper rail parts must be connected with one another to form the complete gripper rails.

U.S. Pat. No. 3,875,808 shows gripper rail parts with stepped end areas. The separating point between the abutting end areas is bridged by a connection piece which is constructed corresponding to the shape of the end areas. The type of clamping of the gripper rail parts with respect to one another is not shown.

German Gebrauchsmunster (DE-GM) No. 82 02 432 shows correspondingly shaped end areas of gripper rail parts which rest on one another during operation and are clamped with respect to one another by screw devices.

In German Patent Specification No. 31 50 508, a separating gap between gripper rail parts is bridged by a gripper rail lock which can be folded open and which is foldably mounted at the gripper rail part remaining in press. The connection of the gripper rail parts among one another takes place utilizing screw devices.

German Patent Application Ser. No. 32 35 308 shows an adjusting device for the coupling and uncoupling which is inserted into a gripper rail part. This adjusting device is used for the securing of the form closure formed by correspondingly shaped end areas of the gripper rail parts, after the joining.

In the arrangement according to German Patent Application Ser. No. 35 20 343, a separating gap is formed between the gripper rail parts. This separating gap must be filled by thrust pieces before the gripper rail parts are clamped with respect to one another. The insertion of the thrust pieces into the separating gap and the subsequent clamping of the gripper rail parts with respect to one another is achieved utilizing an adjusting device which is fastened in the end area of a gripper rail part. The adjusting device has a clamp bolt which moves the thrust pieces and can be placed, by a clamping head, behind a clamping surface in the gripper rail part to the clamped and can be locked by being pulled back.

In addition, arrangements for the coupling and uncoupling of gripper rail parts of a transfer press are disclosed by German Patent Application Ser. No. 36 36 010 and German Patent Application Ser. No. 36 36 011. The clamping devices which are required for this purpose are arranged in the end areas of the gripper rail parts. In this case, a bridge part is guided along with the clamp bolt to which two centering bolts are fastened for the centering of the gripper rail parts with respect to one another, and at which a guide bolt is also carried along for the shifting of a movable carriage at the external form of the gripper rail part accommodating the clamping element.

Each of the arrangements of the above-noted documents require that the gripper rail parts consist of several parts at the end areas. The mounting of an individual part must take place directly at the end areas of the gripper rail parts and, in addition, considerable cutting is required as well as welding operations at the gripper rail parts during the preassembly and assembly.

In contrast, it is an object of the present invention to integrate the elements for the coupling and uncoupling of gripper rail parts into a constructional unit, in order to significantly simplify the construction of the end areas of the gripper rail parts to be connected and thus the working of the end areas and the mounting arrangement at the connection site.

The constructional unit, as a whole, can be advantageously preassembled, stored and transported and can be fixed at the gripper rail parts as a completely assembled part, and forms the coupling plane which is required for an operating condition wherein the gripper rail components are changed simultaneously with a tool change of the press.

According to one embodiment of the present, all clamping devices are advantageously surrounded by a separable housing to form the constructional unit which, as a whole, is readily assembled for installation and as such can also be exchanged with a replacement.

The cross-sectional dimensions of the constructional unit advantageously correspond to the cross-sectional dimensions of the end areas of the gripper rail parts to be connected so that only components project beyond the connection which are required for a different use. The constructional unit can also be used in gripper rails having gripper rail parts made of flat rail material. Existing gripper rails, even those with a different coupling construction, can be advantageously retrofitted. Further the constructional unit may be used for gripper rail parts, in which partition lines are required at the coupling planes, but particularly also for gripper rail systems which have no partition lines, in which the gripper rail parts must be coupled by a flange-type pressing on one another of the front faces at the end areas of gripper rail parts to be connected.

Other objects, advantages and novel features of the present invention will become apparent from the following detailed description of the invention when considered in conjunction with the accompanying drawings.

DETAILED DESCRIPTION OF THE DRAWINGS

The invention will be explained in the following with reference to the embodiments illustrated in the figures.

Figure 4:
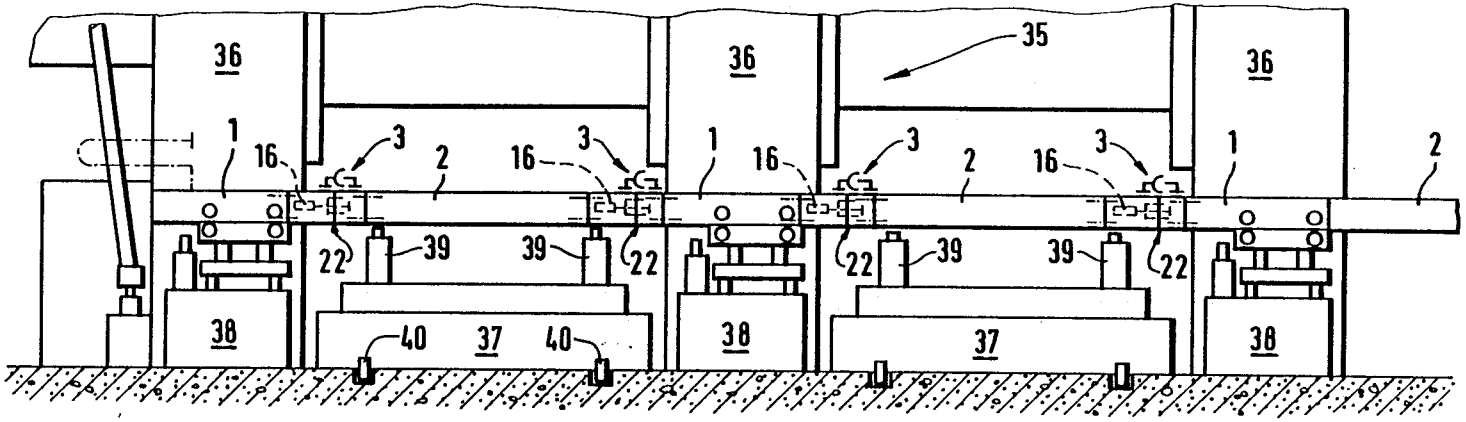
FIG. 4 is a transfer press with gripper rails in which the invention is used.

The transfer press 35 which is partially shown in FIG. 4 has gripper rails between the clearances of the press frames 36 and has liftable and lowerable sliding tables 37 which, by means of rollers 40, can be moved into and out of the transfer press 35. The gripper rails are formed from gripper rail parts 1, 2, which are connected with one another by complete constructional units 3. The constructional units 3 form coupling planes 22 for the separating of the gripper rail parts 2 which, can be moved out of the transfer press during the changing, by sliding tables 37 having supporting devices 39, for supporting removed gripper rail parts 2. An adjusting device 16 is used for the uncoupling and coupling of the gripper rail parts 1, 2. The gripper rail parts 1, which remain in the transfer press 35 and to which gripper rail parts 2 are attached, are driven by deflecting devices 38 to thereby drive the overall gripper rail arrangement.

Figure 1:
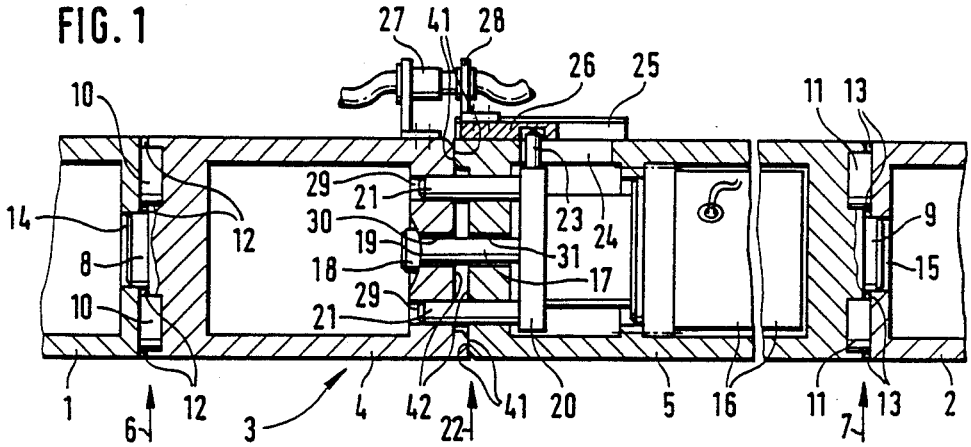
FIG. 1 is a side sectional view of an arrangement according to one embodiment of the present invention which is inserted into end areas of gripper rail parts.

FIG. 1 shows a constructional unit 3 having housing components 4, 5 which are locked between gripper rail parts 1, 2 by means of centering shoulders 8, 9 feather keys 10, 11 and screw devices 33 (FIG. 2) which cooperated respectively with grooves 12, 13 centering bores 14, 15 and threaded bores 34 (FIG. 2) provide at gripper rail parts 1, 2. The mounting planes for the constructional unit 3 at the gripper rail parts 1, 2, in which this constructional unit 3 is mounted as a completely assembled constructional unit in the end areas of the gripper rail parts, 1, 2 are generally indicated by reference numbers 6,7.

The individual parts of the constructional unit 3 are in an assembled condition for installation into the gripper rail parts 1, 2 and for the operation of the gripper rail parts 1, 2 i.e. transfer of workpieces in the transfer press. For both uses, housing component 5 is provided with controllable adjusting device 16 such as, for example, an electrically operated solenoid or the like or a mechanically actuated slide. The adjusting device 16 includes a clamp bolt 17 having a turnbuckle 18 which is guided through opens 30, 31 in housing components 4,5, behind a clamping surface 19 and fixed in the other housing components 4 by a turning and pulling-back of the clamp bolt 17. As a result of this clamping operation the flange surfaces 41, which are entered into the front faces of the housing components 4,5, are pressed against one another. These flange surfaces 41 are formed, for example, by shoulders 42, which are set back behind the flange surfaces 41.

Along with the clamp bolt 17, a bridge part 20 is moved having centering bolts 21 for engagement into centering bores 29 of the other housing component 4. A guide bolt 23 is fastened to the bridge part 20 which is guided through an opening 24 in the wall of the housing component 5. The guide bolt 23 extends into a carriage 26 which is guided by rails 25 on housing component 5 and which carries one coupling half 28 for engagement with a coupling half 27 located fixedly on the other housing component 5 so that as clamp bolt 17 is moved into engagement with clamping surface 19, coupling half 28 engages coupling half 27.

Figure 2:
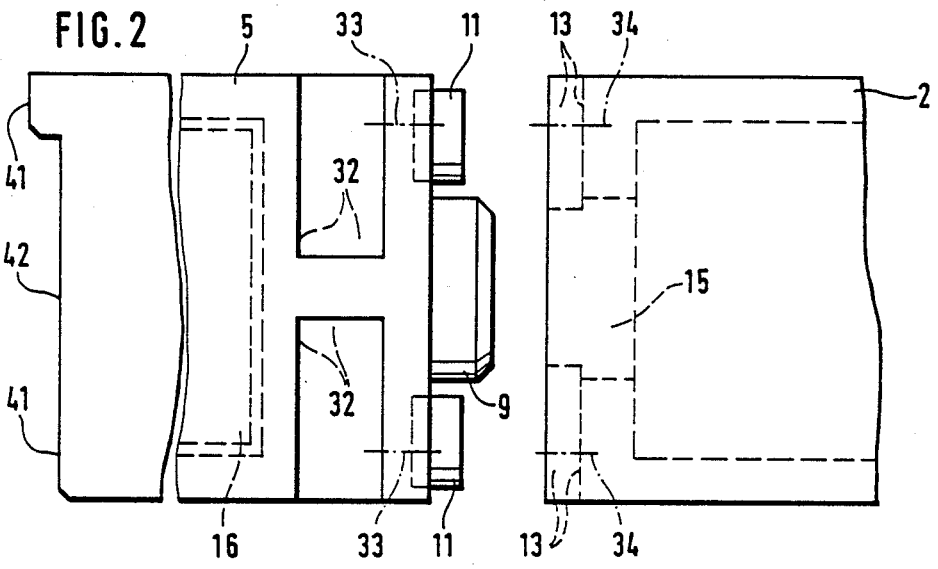
FIG. 2 is an expanded representation of the mounting plane corresponding to arrow 7 in FIG. 1.

In FIG. 2, identical parts have the same reference numbers as in FIG. 1 and reference is made to those numbers. Recesses in the wall of the housing component 5 for the introducing of the screwing devices 33 ar indicated by reference number 32.

Figure 3:
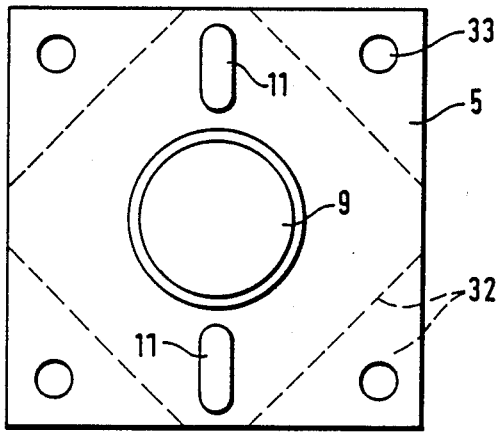
FIG. 3 is a view of one of the front faces of the arrangement according to one embodiment of the present invention.

FIG. 3 is one of the two identical plan views of the constructional unit 3 in the area of the mounting planes 6, 7 (FIG. 1) with the feather keys 11, the centering shoulder 9, the screw devices 33 and the through holes for these screw devices as well as the recesses 32 in the constructional part 5.

Figure 5:
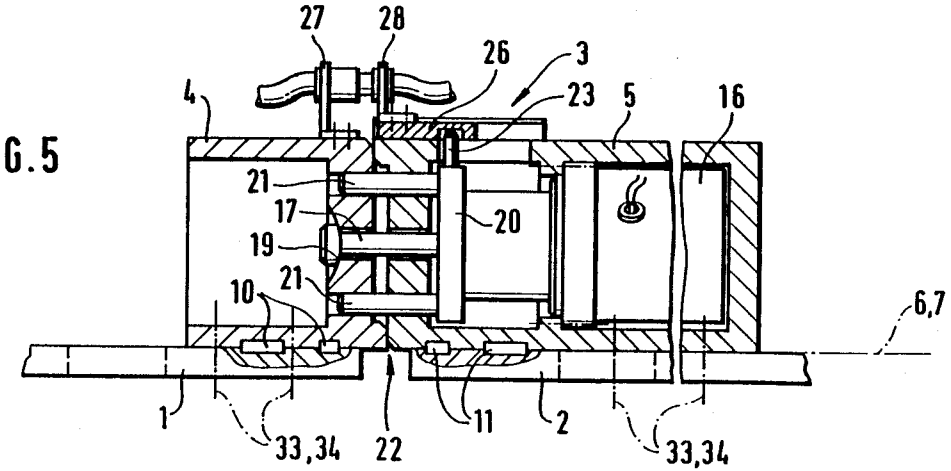
FIG. 5 is another embodiment of an arrangement according to the invention.

FIG. 5 shows an alternative embodiment using a constructional unit 3 for flat gripper rail parts 1,2. The completely assembled constructional unit is fixed, for example, by means of feather keys 10, 11 for the locking and screw devices 33,34, for the firm connection at the end areas of the gripper rail parts 1,2. The devices which are required for this purpose are provided in the mounting plane 6,7 which is common in this case. The reference numbers of the other characterized components correspond to those of the above-described embodiment.

Although the present invention has been described and illustrated in detail, it is to be clearly understood that the same is by way of illustration and example only, and is not to be taken by way of limitation. The spirit and scope of the present invention are to be limited only by the terms of the appended claim.

What is claimed:

1. An arrangement for coupling and uncoupling gripper rail parts of a gripper rail system of a transfer press during changing of the gripper rail parts while the transfer press is set up for working another workpiece comprising:

a constructional unit, comprising two housing component means, which, when the gripper rail parts are installed and are assembled to the gripper rail system, in the transfer press to be newly set up, are inserted as assembled parts between end areas of the gripper rails parts and extensions thereof;

releasable connection means, adjacent end areas of the gripper rail parts, for releasably connecting the two housing component means of the constructional unit, as assembled parts, at the end areas of the gripper rail parts; and coupling means, at adjacent end faces of the two housing component means and entirely carried by the constructional unit, for coupling the two housing component means together during installation and for uncoupling and coupling of the gripper rail parts during the changing of the gripper rail parts.

2. An arrangement according to claim 1, wherein the two housing component means of the constructional unit respectively comprise a first housing component and a second housing component and wherein the first and second housing components are fixed between front-face end areas of the gripper rail parts by the releasable connection means.

3. An arrangement according to claim 2, wherein the releasable connection means include screw means.

4. An arrangement according to claim 2, wherein the releasable connection means further include at least one centered shoulder and at least one feather key.

5. An arrangement according to claim 1, wherein the coupling means comprises:

a controllable adjusting means provided at one of the two housing component means for connecting the two housing components with one another, the controllable adjusting means having at least one clamping element means which can be fixed in complementary counterclamping elements in the other housing component means, and a bridge means, arranged in the one housing component means accommodating the adjusting means, the bridge means, together with the clamping element means moved by the adjusting means, being movable along at least a longitudinal course of the gripper rail parts in the constructional unit, bridge means having at least one centering bolt for aligning the two housing components with respect to one another, and a guide bolt means, for engaging a carriage means movable along an exterior of the constructional unit.

6. An arrangement according to claim 2, wherein the two housing components means have a cross-section substantially the same as the gripper rail parts.

7. An arrangement according to claim 1, wherein the two housing component means each have flange surfaces which are pressed against one another, wherein each of the flange surfaces are substantially flat surfaces and wherein the flange surfaces are interrupted by setback projection means which are interrupted by undercuts.

8. An arrangement for coupling and uncoupling of gripper rail parts of a gripper rail system of a transfer press during changing of gripper rail parts while the transfer press is set up for working another workpiece, comprising:

a construction unit comprising two housing components which, when the gripper rail parts are installed and are assembled to the gripper rails system in the transfer press to be newly set up, are placed as assembled parts at end areas of the gripper rails parts to bridge a coupling plane between gripper rail parts;

releasable connection means, adjacent end areas of the gripper rail parts, for releasably connecting the two housing component of the constructional unit, as assembled parts, at the end areas of the gripper rail parts; and coupling means, at adjacent end faces of the two housing components and entirely carried by the constructional unit, for holding together the two housing components which, at least for the installation, are fixed to one another by the coupling means, the holding together of the two housing components during the installation and the uncoupling and coupling of the gripper rail parts during the changing of the gripper rail parts taking place by the same coupling means.

9. An arrangement according to claim 8, wherein the constructional unit comprises a first housing component and a second housing component and wherein the first and second housing components are fixed adjacent front-face end areas of the gripper rail parts by the releasable connection means.

10. An arrangement according to claim 9, wherein the releasable connection means include screw means.

11. An arrangement according to claim 9, wherein the releasable connection means further include at least one feather key.

12. An arrangement according to claim 8, wherein the coupling means comprises:

a controllable adjusting means provided at one of the housing components in one of the constructional parts for connecting the two housing components with one another, the controllable adjusting means having at least one clamping element means which can be fixed in complementary counterclamping elements in the other housing component, and a bridge means, arranged in the one housing component accommodating the adjusting means, the bridge means, together with the clamping element means moved by the adjusting means, being movable along at least a longitudinal course of the gripper rail parts in the constructional unit, bridge means having at least one centering bolt for aligning of the housing components with respect to one another, and a guide bolt means, for engaging a carriage means movable along an exterior of the constructional unit.

13. An arrangement according to claim 9, wherein the housing components have a cross-section substantially the same as the gripper rail parts.

14. An arrangement according to claim 8, wherein the housing components have complementary flange surfaces which are pressed against one another, wherein each of the flange surfaces are substantially flat surfaces and wherein the flange surfaces are interrupted by setback projection means which are interrupted by undercuts.

* * * * *